US006759617B2

(12) United States Patent
Yoon

(10) Patent No.: US 6,759,617 B2
(45) Date of Patent: Jul. 6, 2004

(54) VACUUM CIRCUIT BREAKER

(75) Inventor: Seok Jung Yoon, Cheongju (KR)

(73) Assignee: LG Industrial Systems Co., Ltd., Seoul (KR)

( * ) Notice: Subject to any disclaimer, the term of this patent is extended or adjusted under 35 U.S.C. 154(b) by 157 days.

(21) Appl. No.: 09/998,133

(22) Filed: Dec. 3, 2001

(65) Prior Publication Data

US 2002/0067230 A1 Jun. 6, 2002

(30) Foreign Application Priority Data

Dec. 4, 2000 (KR) ..... 2000/0072907

(51) Int. Cl.[7] ..... H01H 33/28
(52) U.S. Cl. ..... 218/153; 218/120; 218/140
(58) Field of Search ..... 218/118–120, 140, 218/152–154

(56) References Cited

U.S. PATENT DOCUMENTS 3,787,649 A * 1/1974 Goodwin, Jr. et al. ..... 335/131
4,064,383 A * 12/1977 Barkan ..... 218/154
4,879,441 A * 11/1989 Hamm et al. ..... 218/154
6,313,424 B1 * 11/2001 Bachofen ..... 218/6

* cited by examiner

*Primary Examiner*—Lincoln Donovan
(74) *Attorney, Agent, or Firm*—Birch, Stewart, Kolasch & Birch

(57) ABSTRACT

A vacuum circuit breaker includes a plurality of switching mechanism units having movable contacts and stationary contacts for connecting/breaking an electrical circuit between an electric source and an electric load, respectively, and disposed in a lengthwise direction; an actuator unit including at least one rotary shaft for providing the movable contacts with dynamic power so as to move to positions contacting the stationary contacts or positions separating from the stationary contacts; a supporting frame for fixing and supporting the switching mechanism units and the actuator unit; and a transfer link unit for transferring rotating movement of the rotary shaft to a plurality of vertical movements, whereby the vacuum circuit breaker can be easily installed in a power distributing cabinet and the power of the actuator unit can be evenly transmitted to the plurality of switching mechanism units.

5 Claims, 6 Drawing Sheets

VACUUM CIRCUIT BREAKER

BACKGROUND OF THE INVENTION

This non-provisional application claims priority under 35 U.S.C. § 119(a) on patent application No, 72907/2000 filed in Korea on Dec. 4, 2000, which is herein incorporated by reference.

FIELD OF THE INVENTION

The present invention relates to a vacuum circuit breaker which is one of industrial electric devices used between submission and distribution of electricity on an industrial electric cable, and particularly, to a vacuum circuit breaker which is able to be installed in a narrow electrical power distributing cabinet by disposing a switching mechanism unit and an actuator unit in a lengthwise direction, and at the same time, the power of the actuator unit can be transmitted to a plurality of switching mechanism units evenly.

DESCRIPTION OF THE BACKGROUND ART

Generally, a breaker is a electric protective device which protects electric load devices and an electric power cable from a large accident current caused by an electrical shortage and a ground fault which may be generated on an electric circuit, and it performs a breaking operation automatically when such an accident current is generated, whereby the circuit is broken.

The vacuum circuit breaker is one of the breaker by which the circuit can be broken rapidly by extinguishing an arc in a vacuum chamber when the circuit is opened/closed and when the circuit is broken by a generation of the accident current.

Herein, a vacuum circuit breaker according to the prior art will be described as follows with reference to FIGS. 1, 2, and 3.

FIG. 1 is a front view showing the vacuum circuit breaker according to the prior art, FIG. 2 is a side view showing the vacuum circuit breaker according to the prior art, and FIG. 3 is a side cross sectional view showing an inner structure of the vacuum circuit breaker according to the prior art.

As shown in FIGS. 1 and 2, the vacuum circuit breaker according to the prior art comprises: three switching mechanism units 20 having stationary contacts and movable contacts respectively and corresponding to three-phases alternating current so as to make a main current to flow when normal state and to break the circuit when Ma large accident current is generated; an actuator unit 10 for providing the movable contact with dynamic power so that the circuit between the two contacts of the switching mechanism units 20 is opened/closed; and a supporting and transfer unit 30 for supporting the switching mechanism units 20 and the actuator unit 10, and including transfer mechanisms for transferring the dynamic power from the actuator unit 10 to the switching mechanism units 20 to connect or break the circuit.

In the vacuum circuit breaker described above, the actuator unit 10 is located on front position in Figure, and the three switching mechanism units 10 are disposed on rear position of the actuator unit 10 in widthwise direction for the actuator unit 10. And a supporting and transfer unit 30 is connected to lower parts of the actuator unit 10 and the switching mechanism unit 20, The inner structure of the vacuum circuit breaker according to the prior art will be described with reference to FIG. 3. The inside of the vacuum circuit breaker comprises: a rotary shaft 31 which is rotated in order to transfer the dynamic power generated in the actuator unit 10 to the respective switching mechanism units 20; a lever 32 connected to the rotary shaft 31 so as to be rotated with the rotary shaft 31; a roller 33 coupled to an end of the lever 32 so as to be rotatable; a guide 37 coupled to the lever 32 and including an aperture 37*a* which provides a space in which the roller 33 is able to move in length direction; spring seats 36 and 36' installed on a outer circumference of the guide 37; a compressive spring 35 for providing the roller 33 with an elastic force by being supported by the spring seats 36 and 36'; a transfer lever 38 having one end connected lower end part of the guide 37 and the other end connected to the switching mechanism unit 20 for transmitting the dynamic power from the actuator unit 10 to the switching mechanisms unit 20 while rotating to clockwise direction or to counter-clockwise direction.

In more detail, an insulating rod 21 is coupled to the other end of the transfer lever 38 in vertical direction, and a movable contact 23 which is able to move to a position which contacts to the stationary contact 25 or to a position which is separated from the stationary contact 25 while vertically moving is disposed on upper end part of the insulating rod 21.

Herein, three levers 32, three rollers 33, three guides 37, three compressive springs 35, and three transfer levers 38 are disposed in the actuator unit 10 and in the supporting and transfer unit 30 so as to transmit the dynamic power to the three respective switching mechanism units 20, and the insulating rod 21, the stationary contact 25, and the movable contact 23 are disposed in the three switching mechanism units 20.

The operation of the vacuum circuit breaker of the prior art will be described as follows.

When the actuator unit 10 rotates the rotary shaft 31 and the lever 32 to the clockwise direction so that a circuit between the two contacts 23 and 25 of the switching mechanism unit 20 is closed, the roller 33 compresses the compressive spring 35 and rotates the transfer lever 38 to the counter clockwise direction.

At that time, the insulating rod 21 goes up by the rotation of the transfer lever 38 to the counter clockwise direction, and then the movable contact 23 contacts to the stationary contact 25, so the electrical circuit between the three phases alternative electric source and the electrical load devices is closed.

Also, if the rotary shaft 31 is further rotated to the clockwise direction after the movable contact 23 contacts to the stationary contact 25, then the spring seat 36' abutted to the roller 33 is moved to lower position along with the outer circumference of the guide 35 and compresses the compressive spring 35, the elastically energized spring 35 pushes up the insulating rode 21 of the switching mechanist unit 20 via transfer lever 38, and then the contact between the two contacts 23 and 25 is maintained, whereby the turn-on operation of the vacuum circuit breaker is completed.

On the other hand, if the rotary shaft 31 and the lever 32 are rotated to counter clockwise direction, the roller 33 releases the compressed spring 35 and the transfer lever 38 is rotated to clockwise direction.

At that time, the insulating rod 21 is lowered by the rotation of the transfer lever 38, and the movable contact 23 is separated from the stationary contact 25 then the circuit between the three phases alternative electric source and the electrical load devices is opened. Therefore, the circuit breaking operation of the vacuum circuit breaker is completed.

However, according to the conventional vacuum circuit breaker described above, the actuator unit 20 is located on front position and the three switching mechanism units 20 are located in widthwise direction. Therefore, if the vacuum circuit breaker is installed on rear inside portion of a electrical power distributing cabinet (not shown) which has complex and limited installation space, it is difficult to ensure the installation space inside the power distributing cabinet, and to maintain and repair the vacuum circuit breaker because the space in the power distributing cabinet is limited.

Also, according to the vacuum circuit breaker of the prior art, the power transmitting mechanisms such as the transfer lever 38 for transmitting the dynamic power from the actuator unit 10 to the switching mechanism units 20 are respectively disposed on the three switching mechanism units 20, and therefore the entire number of components is increased and the structure of the apparatus becomes complex. In addition, if the transmitting speed of the power transmitted through the respective transfer levers 38 are different from each other, the opening/closing operations performed by the respective switching mechanism units 20 are not made at the same time, whereby the reliability of the vacuum circuit breaker is reduced.

SUMMARY OF THE INVENTION

Therefore, an object of the present invention is to provide a vacuum circuit breaker in which an actuator unit arid a plurality of switching mechanism units are successively disposed in lengthwise direction, whereby the vacuum circuit breaker is able to be installed inside a power distributing cabinet easily and a maintenance can be performed effectively.

Also, another object of the present invention is to provide a vacuum circuit breaker in which a dynamic power from the actuator unit is able to be distributed evenly to the plurality of switching mechanism units using a common link device, and therefore opening/closing operations of the respective switching mechanism units are performed at the same time and the operation reliability of the vacuum circuit breaker is increased.

To achieve these and other advantages and in accordance with the purpose of the present invention, as embodied and broadly described herein, there is provided a vacuum circuit breaker comprising: a plurality of switching mechanism units having a movable contact and a stationary contact for connecting/breaking an electrical circuit between an electric source and an electric load and disposed in lengthwise direction; an actuator unit including at least one rotary shaft for providing the movable contact with a dynamic power in order to move the movable contact to a position which contacts to the stationary contact or to a position which is separated from the stationary contact; a supporting frame for fixing and supporting the switching mechanism units and the actuator unit; a transfer link means including a transfer link unit, which is coupled to the rotary shaft for transferring the rotating movement of the rotary shaft to horizontally straight movement, for transferring rotating movements of the rotary shaft to a plurality of vertical movements; and a plurality of rotating links having one end pert coupled to the transfer link means and the other end part coupled to the switching mechanism units for transferring the horizontal rotating movement of the transfer link means to vertical movement for position switching of the movable contact.

The foregoing and other objects, featured, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Reference will now be made in detail to The preferred embodiments of the present invention, examples of which are illustrated in the accompanying drawings.

There may be a plurality of embodiments for the vacuum circuit breaker according to the present invention, hereinafter, the most preferred embodiment will be described.

Figure 1:
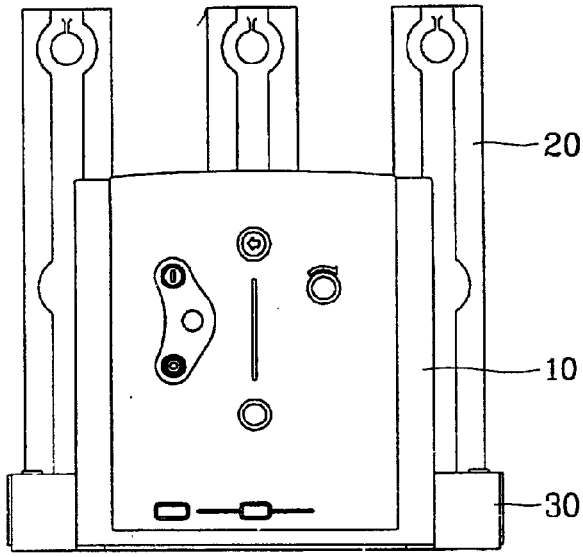
FIG. 1 PRIOR ART
FIG. 1 is a front view showing a vacuum circuit breaker according to a prior art.
Figure 2:
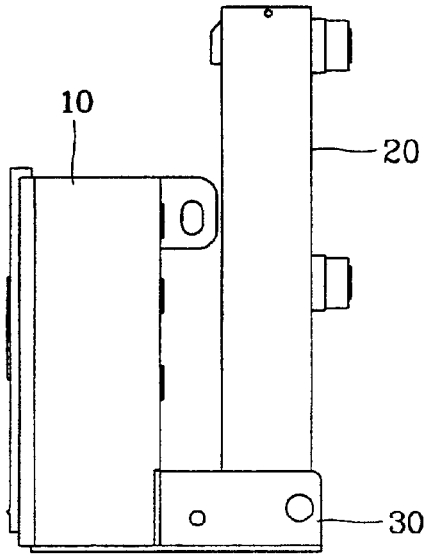
FIG. 2 PRIOR ART
FIG. 2 is a side view showing the vacuum circuit breaker according to a prior ant.
Figure 3:
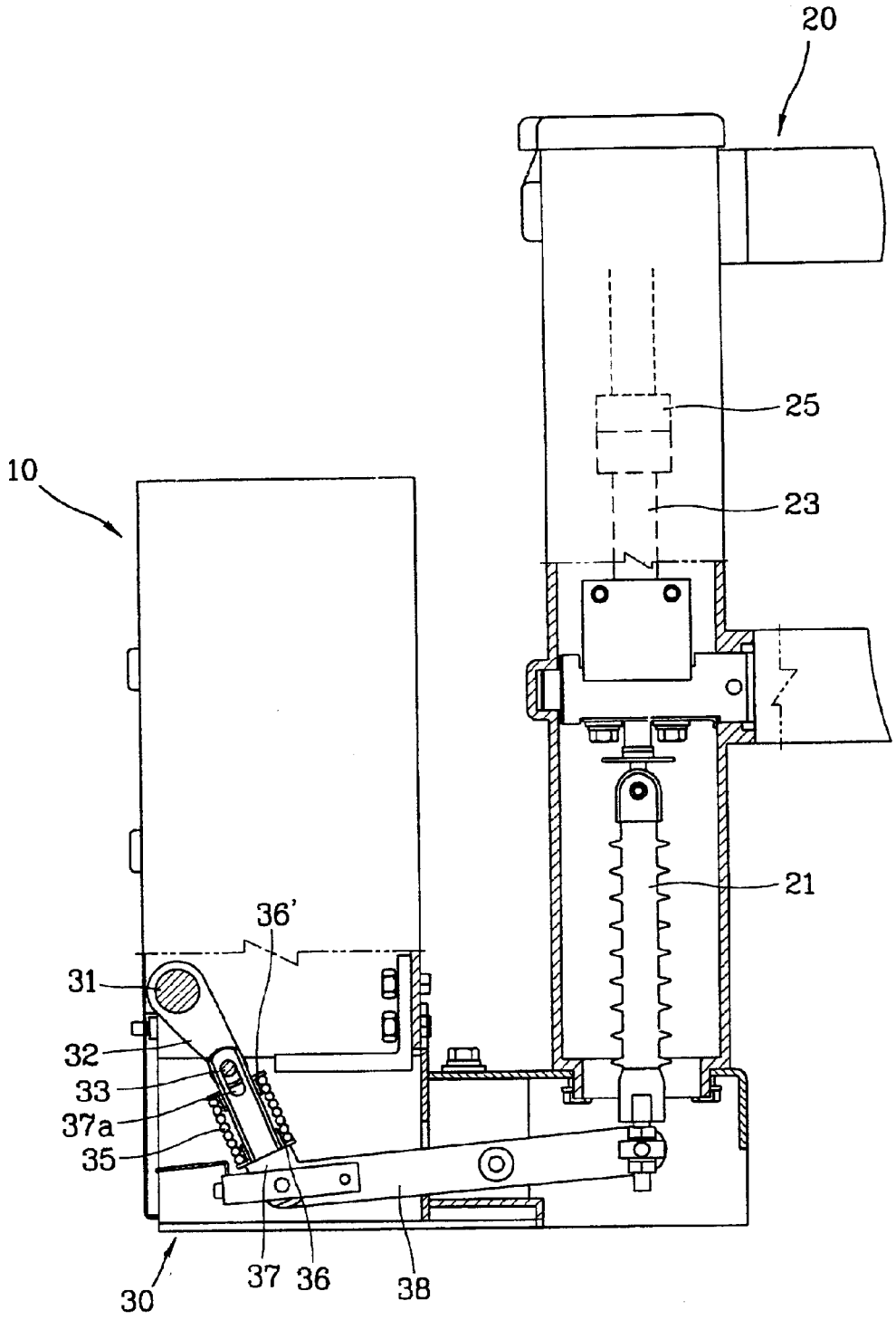
FIG. 3 PRIOR ART
FIG. 3 is a side cross-section detailed view showing the vacuum circuit breaker according to a prior art.
Figure 4:
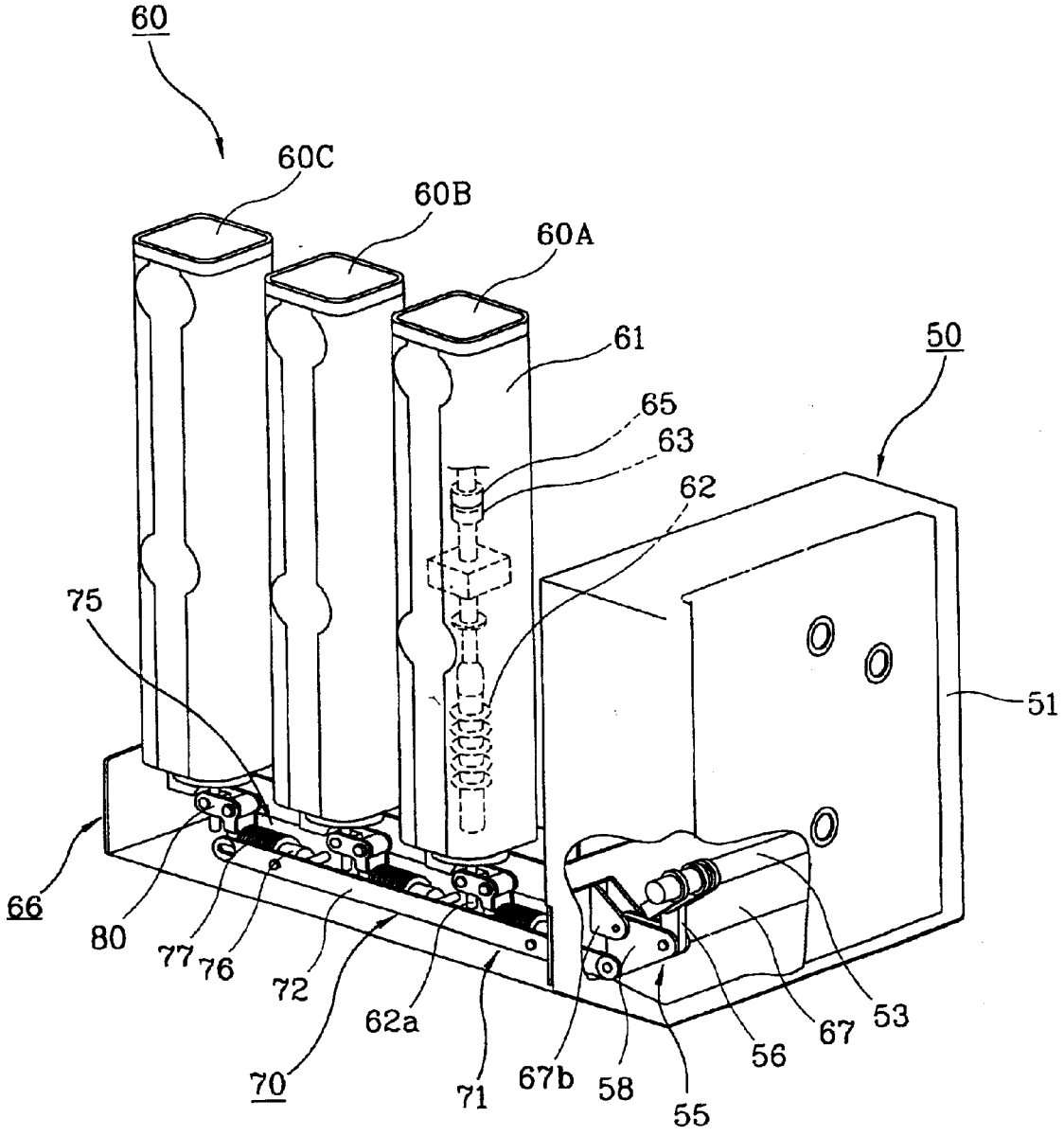
FIG. 4 is a perspective view showing a vacuum circuit breaker according to an embodiment of the present invention.

FIG. 4 is a perspective view showing the vacuum circuit breaker according to the present invention.

As shown therein, the vacuum circuit breaker according to the present invention comprises: three switching mechanism units 60A, 60B, and 60C respectively including movable contacts 63 and stationary contacts 65 for connecting or breaking an electric circuit between an electric source and an electric load, and disposed in a lengthwise direction; an actuator unit 50 having at least one rotary shaft for providing dynamic power so as to move the movable contact 63 to a position where it can contact the stationary contact 65 or to a position where it can be separated from the stationary contact 65; a supporting frame 66 for fixing and supporting the switching mechanism units 60A, 60B, and 60C and the actuator unit 50; and a transfer link unit 70 for transferring rotating movements of the rotary shaft 53 to a plurality of vertical movements. In addition, the transfer link unit 70 comprises a swing link 55 and a straight link 71 coupled to the rotary shaft for transferring the rotating movements of the rotary shaft to horizontal straight movements; and a plurality of rotational link 80 having one end part coupled to the straight link 71 and the other end part coupled to the switching mechanism units 60A, 60B, and 60C for transferring the horizontal straight movement of the straight link 71 to vertical movements for position switching of the movable contact 63. Herein, there are provided three switching mechanism units 60A, 60B, and 60C, which arc included in the switching mechanism 60, so as to correspond to three phases of alternating current of R phase, S phase, and T phase, and these are respectively disposed and fixed on the supporting frame 66 located on the rear portion of the actuator unit 50 in a lengthwise direction.

The respective switching mechanism units 60A, 60B, and 60C comprise: a switching mechanism housing 61 standing on the supporting frame 66 in the vertical direction; a stationary contact 65 located on inner upper part of the witching mechanism housing 61; an insulating rod 62 connected to the transfer link unit 70 and vertically movable inside the housing 61 and a movable contact 63 which is able to move to positions for contact with the stationary contact 65 or separation from the stationary contact 65 by vertically moving, as installed on the upper end part of the insulating rod 62.

Figure 5:
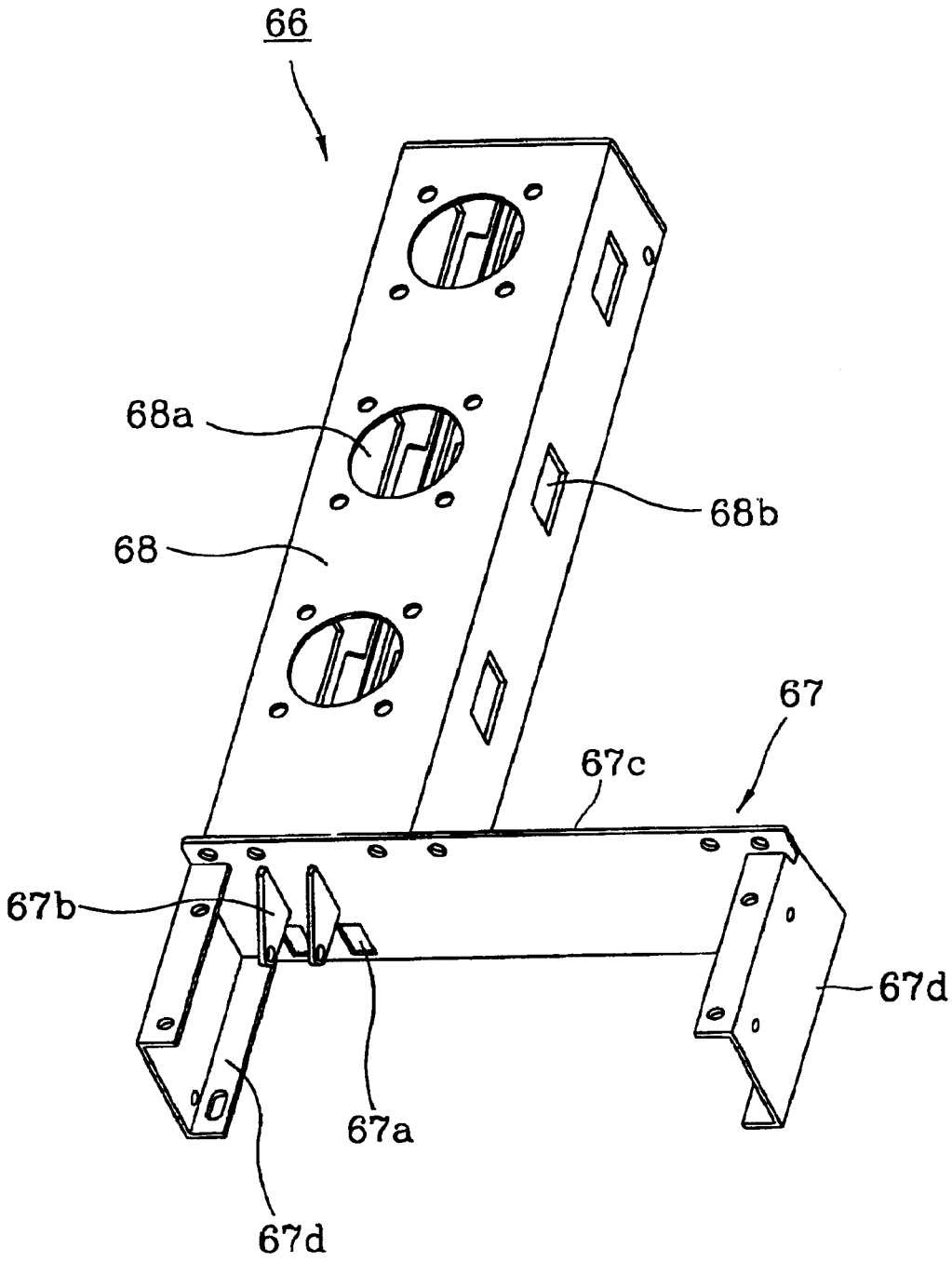
FIG. 5 is a perspective view showing a supporting frame in the vacuum circuit breaker according to the present invention.

The structure of the supporting frame 66 will be described in more detail with reference to FIGS. 4 and 5 as follows.

The supporting frame 66 comprises an actuator supporting bracket 67 for fixing and supporting the actuator unit 50, and a switching mechanism supporting box 68 for fixing and supporting the switching mechanism units 60A~60C.

The switching mechanism supporting box 68 is generally a rectangular member with its one surface facing to the actuator unit 50 being opened. It installed in a lengthwise direction when viewed from the actuator unit 50. Three connecting holes 68*a* corresponding to the three switching mechanism units 60A, 60B, and 60C are disposed on upper surface of the supporting box 68, and therefore the lower end parts of the switching mechanism units 60A, 60B, and 60C and a lower end part of the insulating rod 62 can passes through the holes 68*a*. The lower end part of the insulating rod 62 which passes through the holes 68*a* is connected to the rotational link 80. Four small holes around the respective connecting holes 68*a* which are not defined by reference numerals are screw inserting holes for fixing the switching mechanism units 60A, 608, and 60C on the supporting box 68. A viewing window 68*b* is a means for displaying the ON/OFF state of the vacuum circuit breaker to a User according to the position of the rotational link 80. There may be at least one or three viewing windows corresponding to the switching mechanism units 60A, 60B, and 60C. That is, when an end of the horizontal part on the rotational link 80 of "L" shape is facing to a upper direction, the viewing window 68*b* represents as ON state, and when the end of the horizontal part is facing to a lower direction or to a horizontal direction, the viewing window 68*b* represents as OFF state. Also, the viewing window may be fabricated such that ON is marked on the left upper end of the viewing window 68*b* and the OFF is marked on the left lower end of the viewing window, and then the end part of the horizontal part of the rotational link 80 points to the ON or the OFF marking.

The actuator supporting bracket 67 usually has a "U" shape because side plates 67*c* are bent on both sides of a main plate 67*b*. The main plate 67*b* includes a pair of link through holes 67*a* so that one end part of the straight link 71 can be penetrated through, and a pair of swing lever supporting brackets 67*b* for supporting a second swing lever 58 of the swing link member 55 to swing.

Figure 6:
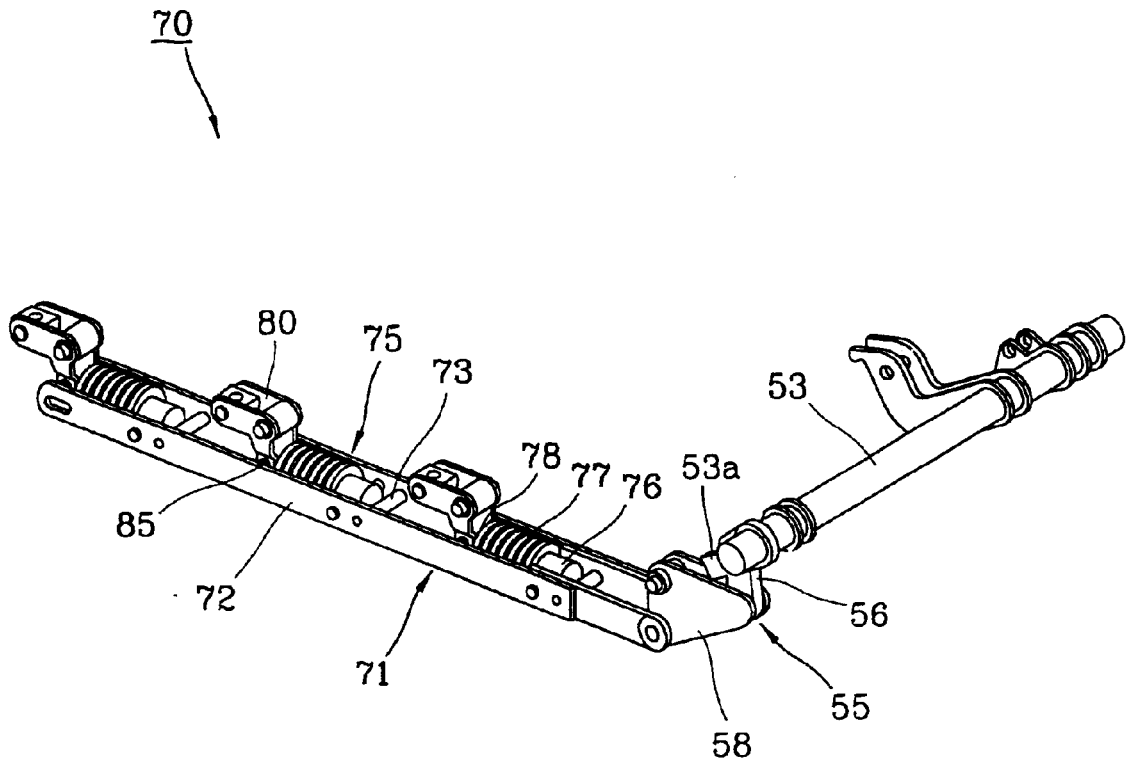
FIG. 6 is a perspective view showing a transfer link unit in the vacuum circuit breaker according to the present invention.
Figure 7:
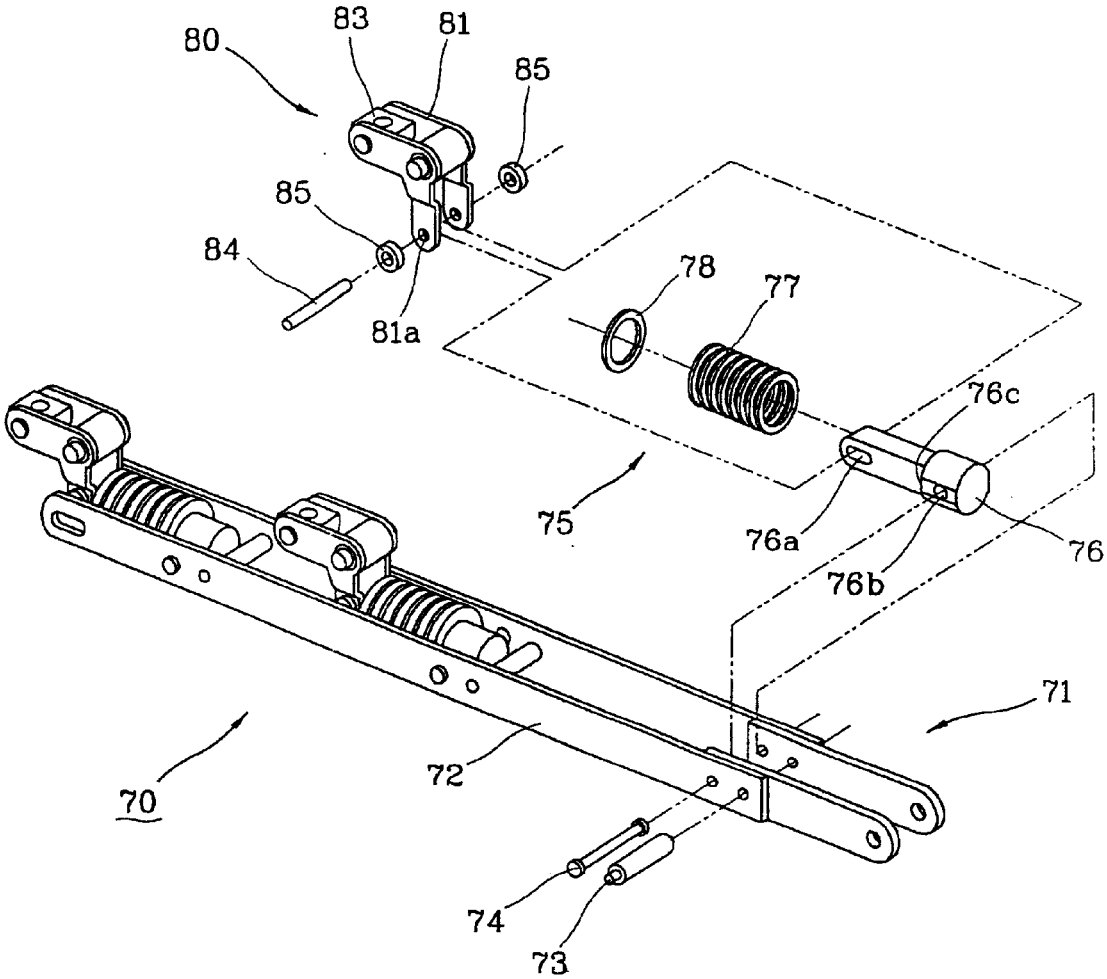
FIG. 7 is an exploded perspective view showing the transfer link unit in the vacuum circuit breaker according to the present invention.

A structure of the transfer link unit will be described with reference to FIGS. 4, 6, and 7 as follows.

The transfer link unit 70 comprises a transfer link means for transferring rotating power of the rotary shaft 53 included in the actuator unit 50 to the horizontal straight movement power, and three rotational links 80 having one end coupled to the transfer link means and the other end coupled to the switching mechanism unit for transferring the horizontal straight movement of the transfer link means to the vertical movement for position switching of the movable contact. The transfer link means comprises a swing link 55 and a straight link 71. Herein, the swing link 55 comprises: a Link connector 53*a* lied on the rotary shaft 53 and swung in correspondence to the rotation of the rotary shaft 53; a first swing lever 56 connected to the link connector 53*a* so as to swing in correspondence with the swing of the link connector 53*a*; and a second swing lever 58 having one end part thereof connected to the first swig lever 56 and the other end part thereof connected to the straight link 71 supported by the swing lever supporting bracket 67*b* so as to swing.

In addition, the straight link 71 includes straight levers 72 which are two long bars extended in parallel with each other with a predetermined gap there between in order to transfer the swing movement of the second swing lever 58 to the horizontal straight movement, and three guide links 75 are located between the pair of straight levers 72 for transmitting the horizontal straight movement of the straight levers 72 to the rotational link 80, and at the same time, pressing the rotary link 80 to maintain between the contacts 63 and 65.

The straight levers 72 are maintained so as to be parallel with each other by connecting the pair of straight levers 72 using three connecting pins 73.

The guide link 75 comprises: a guide rod 76 having one end connected to the straight levers 72 and the other end connected to the rotary link 80, and including an elongate hole 76*a* so as to move in a limited length relatively to the rotary link 80 in the horizontal direction; and an elastic means 77 having one end part thereof supported by the guide rod 76 and the other end part thereof supported by the rotary link 80 via a seat ring 78 for providing an elastic force in a direction for maintaining the contact between the movable contact and stationary contact 63 and 65, respectively. A pin hole 76*b* for penetrating a pin 74 there through is provided on head portion of the guide rod 76, and the elongate hole 76*a* is disposed on the body portion which extended from the head portion with a step therebetween. The pin 74 is a connecting member for connecting the guide rod 76 to the straight lever 72 so as to be rotatable, and at the same time, it becomes a rotating axis when the guide rod 76 is rotated. Therefore, one end part of the spring 77 is supported by a spring seat portion 76*c* made by the step between the head portion and the body portion on the guide rod 76, and the other end part of the spring 77 is supported by the rotary link 80 via a seat ring 78.

In addition, the rotary link 80 is a member of "L" shape, with a horizontal end part of the link 80 being connected to the insulating rod 62 of the switching mechanism units 60A, 60B, and 60C as shown in FIG. 4, and a vertical end part of the link 80 being connected to the elongate hole 76*a* of the guide rod 76 using a connecting pin 84 so as to perform rotational movement and horizontally straight movement with a predetermined limit.

The rotational link 80 above is made by coupling two side plates 81 of "L" shape in parallel with a predetermined gap therebetween. A rotational joint 83 is installed between the side plates 81 so as to rotate relative thereto in a state that the lower end part 62*a* of the insulating rod 62 which is a connecting member between the switching mechanism units 60A, 60B, and 60C, is inserted as shown in FIG. 4.

In addition, a pair of pin holes 81*a* are disposed on the lower end of the vertical part of the pair of side plates 81, and a pair of roller 85 are disposed on the outer sides of the pin holes 81*a*, The rollers 85 are installed on both end parts of the connecting pin 84 which penetrates the elongate hole 76*a* of the guide rod 76 and the pin hole 81*a* of the rotary link 80 so as to be rotatable, and they are prevented from escaping from the connecting pin 84 by an escape preventing member such as a washer, which is not shown.

The roller 85 presses the spring 77 via the seat ring 78 in order to store the elastic energy which is provided for maintaining contact between the movable contact and the stationary contact 63 and 65, respectively, during the ON operation of the vacuum circuit breaker.

On the other hand, the seat ring 78 (so called, washer) supports the other end of the spring 77, and accommodates the pressure from the rollers 85 for distribution to the spring 77, evenly. That is, in a usual compressive spring, both ends of the spring protrude in the vertical direction from the circumferential surface of the spring or the length between both ends is shorter than the diameter of the spring, and therefore the surfaces of both ends are not even. Therefore, if the rollers 85 are in direct contact with the spring 77 without an interposition of the seat ring 78, one roller 85 is contacted to the spring 77 and the other roller 85 is not in contact with the spring, whereby the pressure of the rollers 85 may not be evenly transmitted to the spring 77. At that time, a length of the spring 77 compressed by the rollers 85 are limited so as to depend on the length of the elongate hole 76*a* of the guide rod 76.

The operation of the vacuum circuit breaker according to the present invention will be described as follows.

As shown in FIG. 4, when the rotary shaft 53 is rotated in the clockwise direction according to the operation of the actuator unit 50, the first swing lever 56 and the second swing lever 58 are swung in the clockwise direction through the link connector 53*a*. At that time, the straight link 71 is moved far from the actuator unit 50, that is, at the left side of the Figure, and therefore the three rotational links 80 are rotated in the clockwise direction at the same time.

At that time, the insulating rod 62 is vertically raised in the switching mechanism units 60 according to the rotation of the rotational links 80 in the clockwise direction, and therefore the movable contact 63 is also raised. Then the movable contacts 63 contacts the stationary contact 65, and the circuit between the electric source and the electric load is connected. That is, the vacuum circuit breaker Is in the ON status.

When the straight link 71 transmits the dynamic power from the actuator unit 50 to the horizontal straight direction, it provides respective rotational links 80, which are connected to a common straight link 71 with predetermined intervals, with identical power and speed. Therefore, the movable contacts 63 in the respective switching mechanism units 60A, 60B, and 60C are placed in contact with the stationary contacts 65 with even force.

Also, when the rotary shaft 53 is rotated further in the clockwise direction by the dynamic power of the actuator unit 50 in the state where the movable contact 63 and the stationary contact 65 are firstly contacted, the straight link 71 is further moved to the left side of the Figure. At that time, the three guide rods 76 are also moved to the left side of the Figure with the straight link 71, and accordingly, the roller 85 compresses the compressive spring 77 in the length limit of the elongate hole 76*a* on the guide rod 76 and stores the elastic energy of the compressive spring 77. Therefore, the rotational link 80 maintains the state to raise the insulating rod 62 upwardly by receiving the elastic energy of the compressive spring 77 in the state that the further rotation in the clockwise direction of the rotational link 80 is blocked. Then the movable contact 63, connected to the insulating rod 62, maintains the state of contacting the stationary contact 65.

Therefore, the state where the movable contact 63 in contact with the stationary contact 65 is maintained by the elastic force provided from the compressive spring 77 to the rotational link 80, the vacuum circuit breaker ON state of the actuator unit 50 is completed On the other hand, the breaking operation of the vacuum circuit breaker according to the present invention will be described as follows with reference to FIG. 4. When the rotary shaft 53 is rotated in the counter clockwise direction by the operation of the actuator unit 50, the first swing lever 56 and the second swing lever 58 are swung in the counter clockwise direction through the link connector 53*a*. At that time, the straight link 71 is moved close to the actuator unit 50, that is, to the right side of the Figure. Therefore, the three rotational links 80 are rotated in the counter clockwise direction at the same time.

At this time, the rotational links 80 are rotated in the counter clockwise direction, and accordingly, the respective insulating rods 62 are vertically lowered in the switching mechanism units 60 and the movable contacts 63 are also lowered. The movable contacts 63 are separated from the stationary contacts 65, whereby the circuit between the electric source and the electric load is turned off. That is, the vacuum circuit breaker is placed in the OFF state.

When the straight link 71 transmits the dynamic power from the actuator unit 50 to the horizontally straight direction, it provides the respective rotational links 80, which are connected to a common straight link 71 at predetermined intervals, with identical power and speed. Therefore, the movable contacts 63 in the respective switching mechanism units 60A, 608, and 60C are separated from the stationary contacts 65 with even power.

Also, the spring 77 is compressed by the roller 85 according to the rotation of the rotational links 80 which arm rotated in the counter clockwise direction. However, the spring 77 is extended because the horizontally moving force to the right side of the guide rod 76 which supports one end of the spring 77 is larger than the pressure of the roller 85.

The vacuum circuit breaker according to the present invention as described above provides advantages such that the vacuum circuit breaker can be installed easily inside the power distribution cabinet and mending and repairing the effectiveness can be increased because one actuator unit and a plurality of switching mechanism units are disposed successively in the lengthwise direction.

Also, one common straight link which is roved in the horizontal straight direction so as to distribute and transmit power from the actuator unit to the plurality of switching mechanism units evenly is disposed in the vacuum circuit breaker according to the present invention, and therefore the opening/closing operations of the respective switching mechanism units are smoothly made and the reliability of the vacuum circuit breaker is increased.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. A vacuum circuit breaker comprising:

a plurality of switching mechanism units disposed in a lengthwise direction having movable contacts and stationary contacts for connecting or breaking an electrical circuit between an electrical source and an electrical load respectively;

an actuator unit including at least one rotary shaft for providing the movable contacts with dynamic power so as to move to positions for contacting the stationary contacts or to positions for separating from the stationary contacts;

a supporting frame for fixing and supporting the switching mechanism units and the actuator unit;

a transfer link unit, which includes a transfer link means coupled to the rotary shaft for transferring rotational movement of the rotary shaft to horizontally straight movement, and for transferring rotating movement of the rotary shaft to a plurality of vertical movements; and a plurality of rotational links having one end part coupled to the transfer link means and the other end parts coupled to the switching mechanism units for transferring the horizontally straight movements of the transfer link means to vertical movements for position switching of the movable contacts;

wherein the said transfer link means comprising:

a swing link coupled to the rotary shaft which swing according to the rotating movement of the rotary shaft; and a straight link coupled to the swing link and performing horizontally straight movement according to the swing of the swing link, said straight link including a pair of straight levers having two long bars disposed substantially parallel to each other with a predetermined gap therebetween; and guide links located between the two bars of the straight levers for transmitting the moving forces of the straight levers to the rotary link and pressing the rotational links in a direction by which the contacts of the movable and stationary contacts are maintained.

2. The breaker of claim 1, wherein viewing windows are disposed on the supporting frame for displaying the ON or OFF state of the vacuum circuit breaker by the location of the rotational link.

3. The breaker of claim 1, wherein the swing link comprises:

a link connector fixed to the rotary shaft and swinging with the rotary shaft;

a first swing lever coupled to an end of the link connector and swinging with the link connector; and a second swing lever having one end part coupled to the first swing lever and the other end part coupled to the straight link for transmitting the swing movement of the first swing lever to the straight link.

4. The breaker of claim 1, wherein the guide link comprises:

a guide rod having one end part coupled to the straight levers and the other end part coupled to the rotational link, said guide rod including an aperture for moving horizontally in a limited length relative to the rotational links; and an elastic means supported by the guide rod for providing the rotational links with an elastic force in a direction for maintaining the contact between the movable contacts and the stationary contacts.

5. The breaker of claim 1, wherein the rotational link comprises:

two side plates of "L" shape; and a rotational joint disposed between the two side plates and rotatably connected to a connecting portion of the switching mechanism unit.

* * * * *